United States Patent [19]

Brenner

[11] 4,419,870

[45] Dec. 13, 1983

[54] VALVELESS LIQUID PUMPING AGITATOR FOR AUTOMATIC WASHERS

[75] Inventor: Robert A. Brenner, St. Joseph Township, Berrien County, Mich.

[73] Assignee: Whirlpool Corporation, Benton Harbor, Mich.

[21] Appl. No.: 294,137

[22] Filed: Aug. 19, 1981

[51] Int. Cl.[3] ..... D06F 17/10

[52] U.S. Cl. ..... 68/18 FA; 68/53; 68/134

[58] Field of Search ..... 68/18 FA, 23.7, 53, 68/133, 134, 184

[56] References Cited

U.S. PATENT DOCUMENTS

| | | | |
|---|---|---|---|
| 2,299,554 | 10/1942 | McMahan | 68/53 X |
| 2,909,051 | 10/1959 | Altorfer | 68/134 X |
| 3,022,655 | 2/1962 | Gerhardt | 68/18 FA |
| 3,091,954 | 6/1963 | Bullock | 68/18 FA |
| 3,145,553 | 8/1964 | McMillan | 68/18 FA |
| 4,077,239 | 3/1978 | Platt et al. | 68/184 X |
| 4,338,802 | 7/1982 | Ohmann et al. | 68/18 FA |

*Primary Examiner*—Philip R. Coe

*Attorney, Agent, or Firm*—Hill, Van Santen, Steadman & Simpson

[57] ABSTRACT

A fluid pumping agitator for use in a vertical axis automatic clothes washing machine which pumps wash liquid from an inlet in the skirt portion of the agitator through a venturi to an outlet in the barrel portion of the agitator. The agitator pumps liquid upwardly in both directions of its oscillatory rotational movement. The barrel portion is provided with a filter means for treating the pumped wash liquid.

9 Claims, 8 Drawing Figures

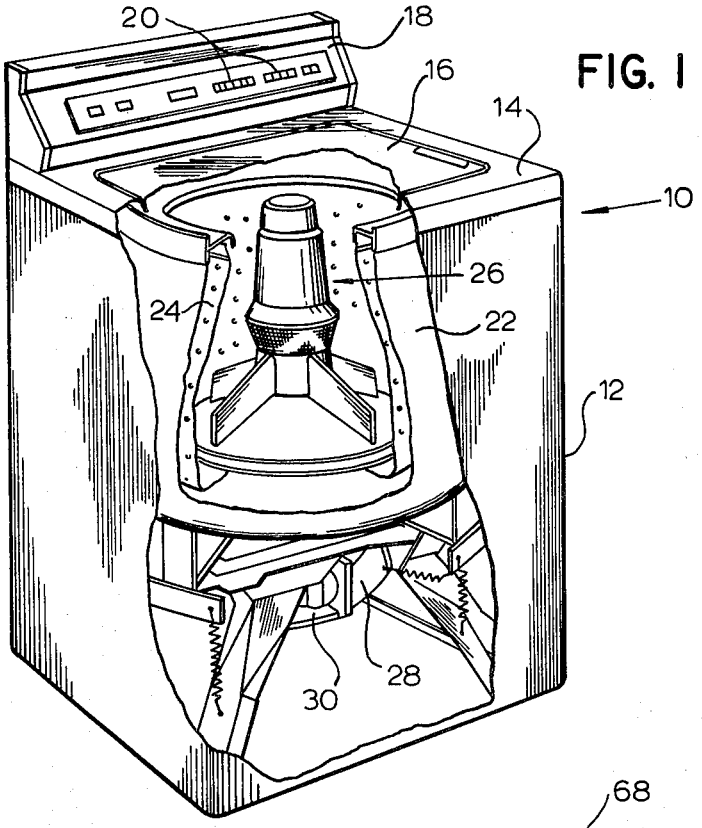
FIG. 1
FIG. 3
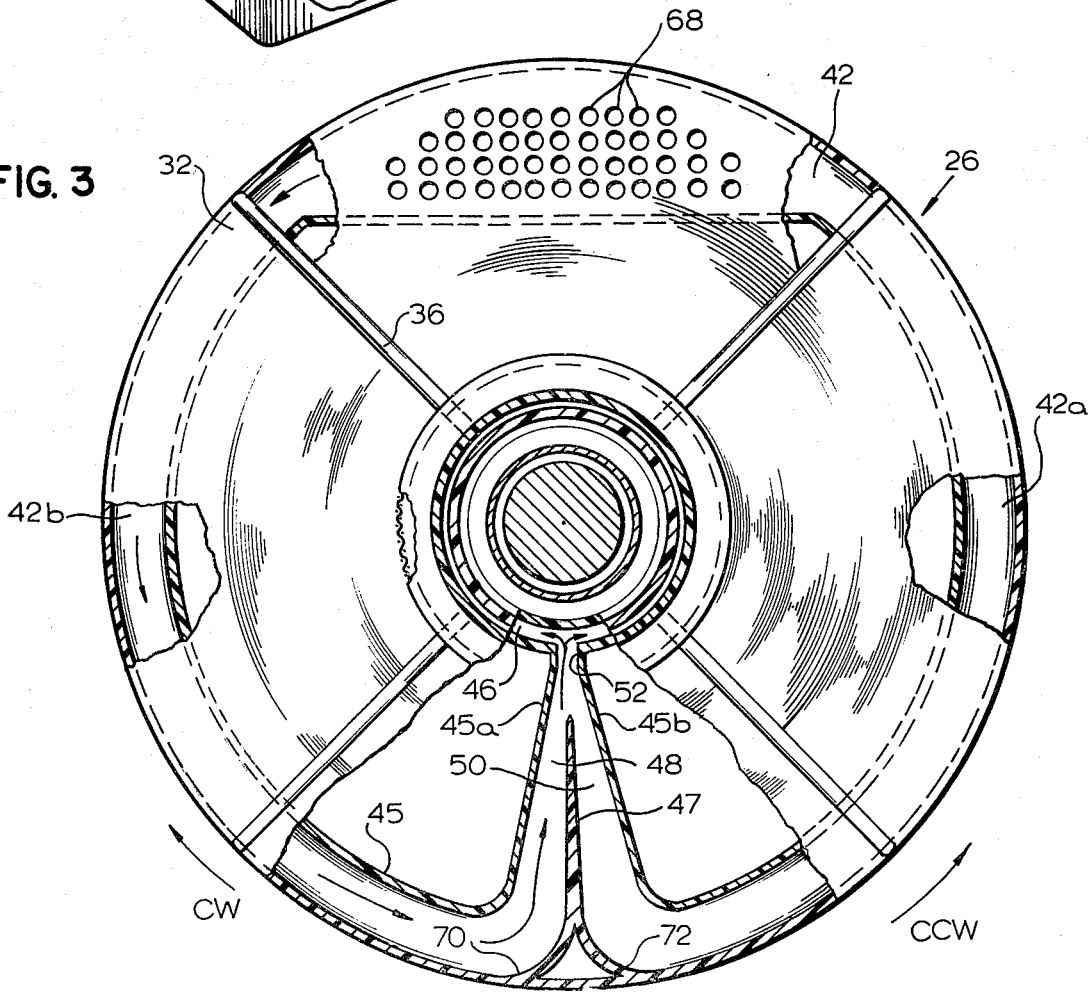

FIG. 2
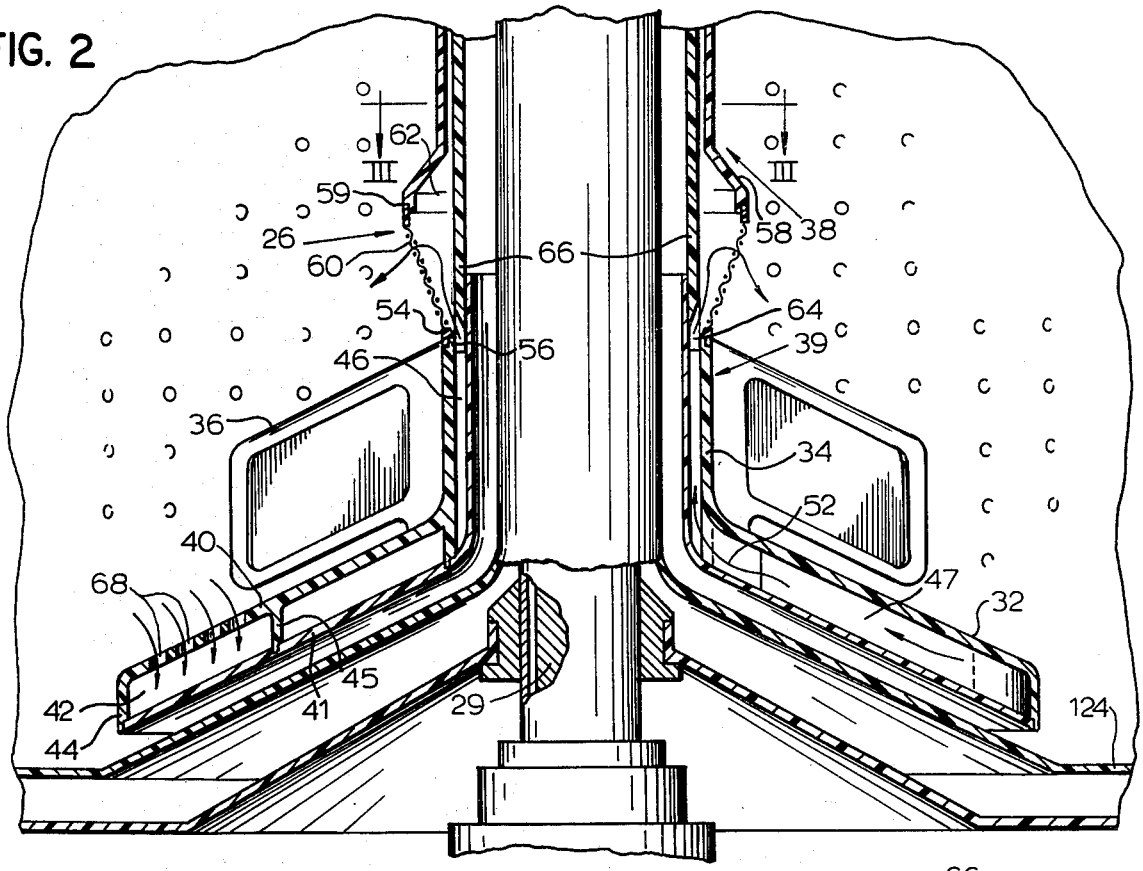
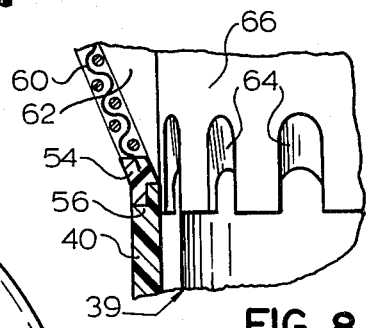
FIG. 8
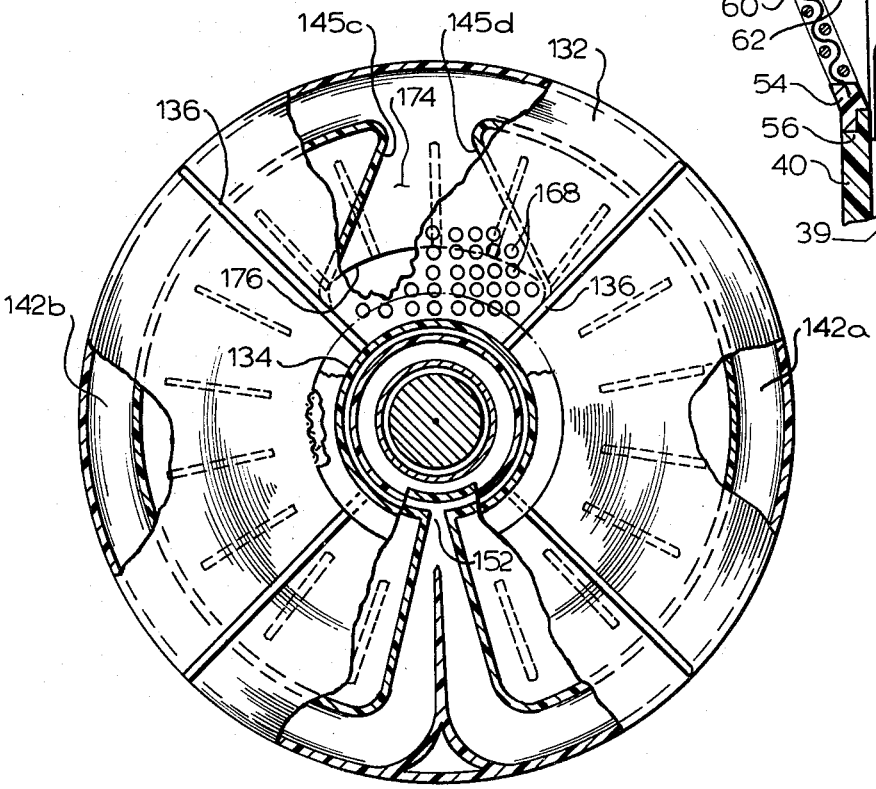
FIG. 4

FIG. 5
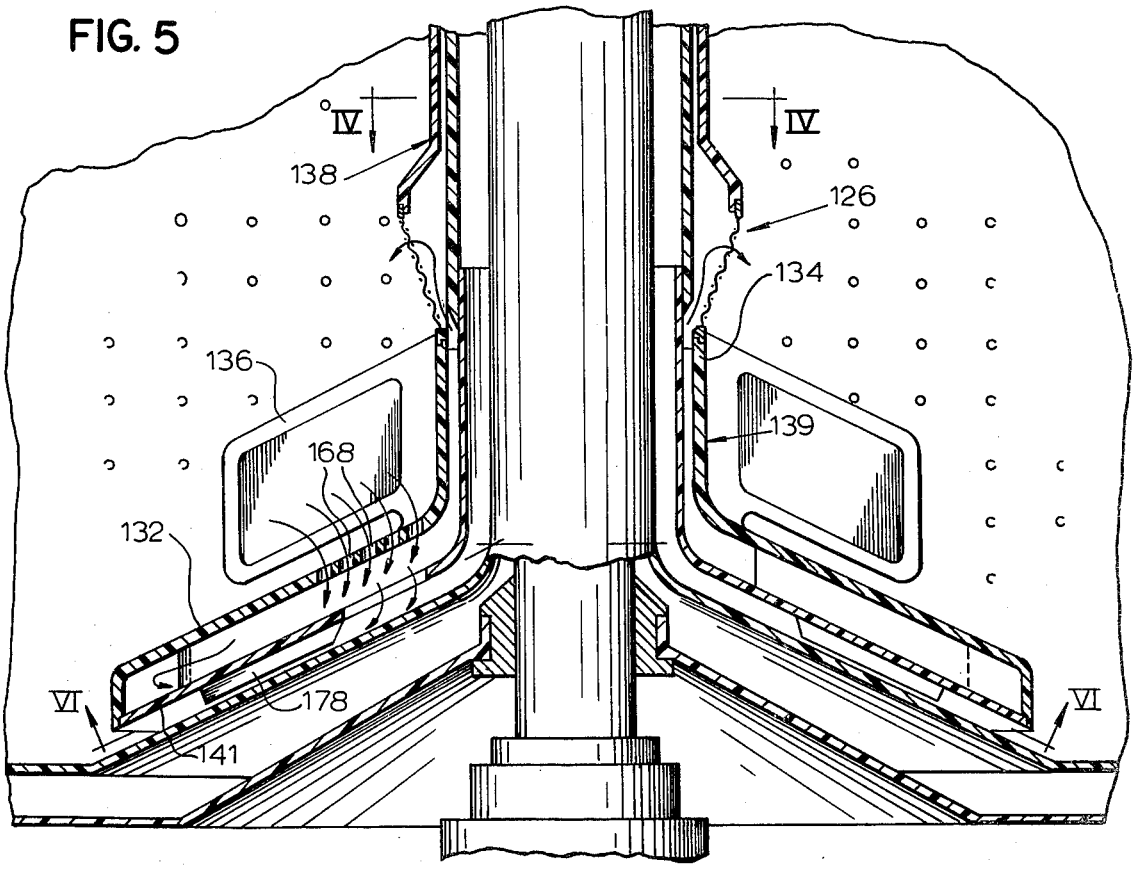
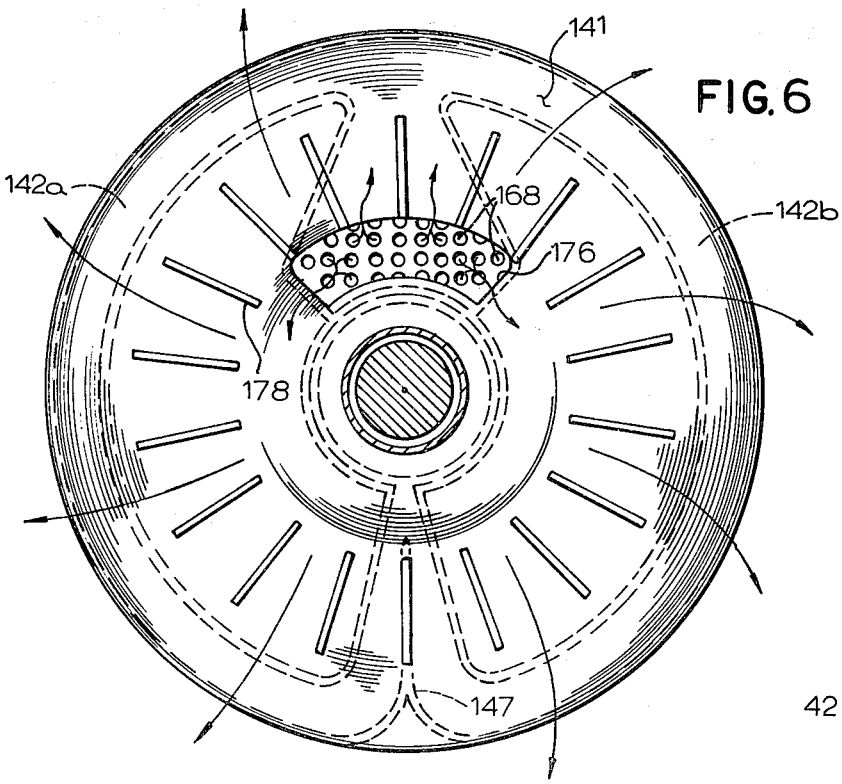
FIG. 6
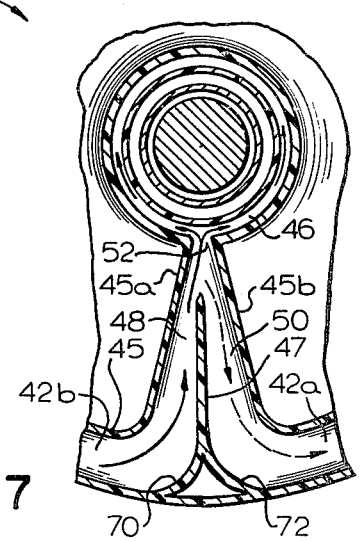
FIG. 7

VALVELESS LIQUID PUMPING AGITATOR FOR AUTOMATIC WASHERS

BACKGROUND OF THE INVENTION

1. Field of the Invention

This invention relates to a washing machine having a valveless liquid pumping agitator, and more particularly to a washing machine wherein wash liquid is pumped upwardly through the interior of the agitator during the wash cycle.

2. Description of the Prior Art

Various attempts have been made at pumping wash liquid upwardly through the agitator of an automatic washing machine during the washing cycle. U.S. Pat. No. 2,909,051 discloses a wash liquid pumping agitator in which the agitator travels through an orbital path as opposed to rotating about a center axis and within the interior of the agitator there is provided a positive displacement pump which has an expanding and contracting chamber integrally connected with a cam arrangement to force the wash liquid upwardly through the agitator. Check valves are provided to maintain the flow of wash liquid up through the agitator in one direction.

U.S. Pat. No. 3,022,655 discloses a valveless pumping agitator which utilizes four spiral portions to ram wash liquid through inlet openings 26 upwardly through the spiral passage to the barrel of the agitator when the agitator moves in the clockwise portion of an oscillatory movement.

U.S. Pat. No. 3,091,954 discloses a positive displacement piston pump utilizing a fixed check valve and a floating check valve to pump wash liquid upwardly through the agitator as the agitator moves up and down in a reciprocating motion.

U.S. Pat. No. 3,145,553 discloses a vaned positive displacement pump which utilizes two sets of check valves to provide the wash liquid flow upwardly through the agitator to an agitator mounted filter.

SUMMARY OF THE INVENTION

In accordance with the present invention a valveless wash liquid pumping agitator for an automatic washer is provided wherein the inertia of the wash liquid in the washer basket relative to the oscillatory movement of the agitator is used to force the wash liquid to follow a path through a channel in the skirt of the agitator, through a venturi and up the barrel to discharge from the barrel into the basket at a point above the skirt. The channel in the agitator comprises an annulus around the skirt of the agitator having an inlet in the top wall of the agitator skirt and a venturi outlet on the opposite side of the annulus from the inlet opening to a vertical channel extending up the interior of the agitator barrel.

The annulus thus provides two channel passages from the inlet to the venturi outlet around opposite circumferential sides of the agitator skirt. The wash liquid flowing inwardly through the venturi causes a decrease in pressure as it speeds up passing through the venturi tending to create a low pressure zone retarding the outward flow of wash liquid in the channel passage. Therefore, a net flow of wash liquid enters the center portion of the agitator and is pumped upwardly through the vertical channel in the agitator to a filtering means.

Thus, as the agitator rotates in a first direction, the wash liquid in a first channel portion moves toward the venturi and the liquid in a second channel portion moves away from the venturi. Movement of the wash liquid in the second channel portion is retarded by the low pressure zone formed by the venturi, thus causing a net flow of wash liquid from the inlet through the first channel portion and venturi up the vertical channel in the barrel. The inertia of the wash liquid relative to the reversed movement of the agitator forces the wash liquid to follow the path from the outlet of the annular channel up the channel in the barrel.

As the agitator rotates in the second opposite direction the inertia of the wash liquid in the second channel portion causes a flow of wash liquid from the inlet through the second channel portion and the venturi up the vertical channel in the barrel while the low pressure zone formed by the venturi retards movement of wash liquid in the first channel portion. Thus, the valveless agitator with venturi provides a means for pumping the wash liquid in both directions of movement of the agitator as it oscillates.

An alternative embodiment of the present invention provides an opening through the bottom wall of the skirt communicating with the annular channel. A plurality of pumping vanes are located on the bottom side of the skirt bottom wall which pump wash liquid out from under the skirt thereby drawing liquid in through the skirt inlet opening. This arrangement increases flow through the venturi and prevents clothing from being pulled under the agitator skirt during the wash cycle.

The wash liquid which has been forced up the vertical channel in the barrel can be used for various functions such as filtering and/or dispensing of wash additives.

BRIEF DESCRIPTION OF THE DRAWINGS

FIG. 1 is a perspective view of a washing machine embodying the present invention, partially cut away to show the interior mechanism thereof.

FIG. 2 is a side sectional view of the agitator assembly within the tub and basket of the washing machine.

FIG. 3 is a sectional view of the agitator partially cut away and taken generally along the lines III—III of FIG. 2.

FIG. 4 is a sectional view partially cut away of an alternative embodiment of the agitator taken generally along the lines IV—IV of FIG. 5.

FIG. 5 a side sectional view of an alternative embodiment of the agitator assembly within the tub and basket of the washing machine.

FIG. 6 is a plan view of the skirt portion of the agitator shown in FIG. 5 as viewed along the lines VI—VI of FIG. 5.

FIG. 7 is a partial cut away view of the venturi in the agitator skirt.

FIG. 8 is a partial side sectional view of the agitator barrel taken near the outlet and filter means.

DESCRIPTION OF THE PREFERRED EMBODIMENTS

A laundry appliance 10 comprising an automatic clothes washer embodying the principles of the present invention is depicted in FIG. 1. The washer is comprised of a cabinet 12 having a top 14 with an openable lid 16 and a console 18 having presettable controls 20 thereon of the type wherein an operator may pre-select a program of automatic washing, rinsing and spinning steps in a laundering process. The openable lid 16 in the top 14 of the cabinet 12 permits access into the top of a tub 22 housed within the cabinet 12. Enclosed by and supported within the tub 22 is a clothes container or a spin basket 24 within which is oscillatably mounted an agitator 26.

Below the tub 22 but within the cabinet 12 there is provided an electric motor 28 which oscillatably drives the agitator 26 through a transmission 30. The agitator 26 is shown in greater detail in FIGS. 2 and 3 where it is seen that the agitator 26 is comprised of a skirt portion 32 near the bottom of the agitator and a substantially vertical barrel portion 34 integrally connected with the skirt and projecting upwardly therefrom. A plurality of flexible vanes 36 are provided around the periphery of the barrel 34 and extend downwardly and outwardly along the skirt portion 32 of the agitator 26.

The agitator is suitably attached to an agitator shaft 29 for oscillatory motion in a conventional manner as fully described in application Ser. No. 35,935 filed May 4, 1979 by Anthony Mason and assigned to the assignee of this application.

The agitator 26 is of a two part construction having an upper portion 38 and a lower portion 39. The skirt portion 32 of the lower portion 39 is comprised of an upper outer wall 40 and a lower inner wall 41 which form an annular space or channel 42 therebetween which extends virtually around the entire circumference of the skirt portion. A first substantially vertical circumferential wall 44 and a second substantially vertical circumferential wall 45 spaced radially inwardly of the first wall 44 define the side walls of the annular channel 42. As best seen in FIG. 2 the barrel portion 34 of the lower portion 39 likewise has a substantially vertical annular space or channel 46 provided between the vertical extensions of the inner wall 41 and the outer wall 40.

A radially inwardly projecting wall 47 prevents direct communication throughout the entire circumferential extent of channel 42 at the periphery of the skirt 32. Circumferential wall 45 has radially inwardly disposed portions 45*a* and 45*b* adjacent either side of wall 47 to provide two converging channel portions 48 and 50 which provide communication between annular channel 42 and annular space 46 through a narrow throat portion outlet 52 which comprises a venturi. Wall 47 terminates radially outwardly from the venturi 52.

The upper portion 38 of the agitator 26 slides over the barrel 34 of the lower portion 39 and has a lower end 54 which removably mates with an upper end 56 of the outer wall 40 of the lower portion 39 of the agitator 26 as shown in FIGS. 2 and 8. Above the lower end 54 of the upper portion 38 there is provided a conically shaped flange 58 which projects outwardly and downwardly and terminates in a lower end 59 to which is secured a conically shaped filter means 60 which is also secured to the lower end 54 of the upper portion 38.

In this manner, a chamber 62 is provided between the upper and lower portions of the agitator 26. Communication is provided between the chamber 62 and the annular space 46 in the lower portion 39 by means of a series of slots 64 in a wall 66 forming an upward extension of the barrel 34 of the lower portion 39. The wall 66 is secured to the inner wall 41 and outer wall 40 of the lower portion 39 and blocks the upward flow of wash liquid except through slots 64 into filter chamber 62.

The upper portion 38 including the filter means 60 is removable from the lower portion 39 which permits removal and cleaning of the filter means 60 at appropriate times. During operation of the washer 10, the upper portion 38 is secured to the lower portion 39 to prevent separation therebetween.

A plurality of inlet openings 68 are provided in the outer wall 40 in the skirt portion 32 opposite the venturi throat 52 and adjacent the periphery of the skirt. The filter means 60 provides outlet openings to the basket 24. To exit from the chamber 62 the wash liquid must pass through the filter means 60. Thus, there is provided a fluid path from the interior of the basket 24 through the inlet openings 68 in the skirt portion, through annular channel 42, channel portions 48 and 50, through the venturi 52, into the vertical channel 46, up through slots 64 into the cavity 62 and out through filter means 60.

As seen in FIG. 3, the liquid has two flow paths between inlet openings 68 and the venturi 52. As viewed in FIG. 3 these two paths are the right half of channel 42 being designated 42*a* and the left half of channel 42 being designated 42*b*. The wall 47 separates channel portion 42*a* from 42*b*.

Periodically throughout the steps of the washing operation, the agitator is driven in an oscillatory manner such that part of its movement is in a clockwise direction as shown by arrow CW and another part of its rotation is in a counterclockwise direction as shown by arrow CCW. During this movement, there is a supply of wash liquid within the basket 24 which is generally above the level of the skirt portion 32 of the agitator 26 such that the wash liquid enters the inlet openings 68 and completely fills the entire annular channel 42. As agitator 26 oscillates, it acts as a pump in the following manner.

As the agitator moves in the clockwise direction as shown by arrow CW, the inertia of the wash liquid within the channel 42 tends to result in a relative rotational movement between the liquid and the agitator 26. In this manner the liquid in the channel portion designated 42*b* moves toward a curved portion 70 of the wall 47, as seen in FIG. 7, causing the liquid to be diverted or impelled into channel portion 48, through venturi 52 and up through vertical channel 46, through slots 64 into the chamber 67, through filter means 60 and out into the basket 24. Liquid in channel portion 42*a* tends to move away from wall 47 thus drawing liquid from channel portion 50. However, a low pressure zone caused by liquid passing through the venturi 52 retards movement of the liquid in channel portion 50 away from the venturi 52. Thus, there results a net flow of liquid radially inwardly through the venturi.

As the agitator 26 reverses its motion and begins rotating in a counterclockwise direction, as shown by arrow CCW, the liquid in channel portion 42*a* moves toward a curved portion 72 of the wall 47 causing the liquid to be diverted or impelled into channel portion 50 through venturi 52 and up through vertical channel 46, through slots 64 into chamber 62 and out through filter means 60 into the basket 24. Liquid in channel portion 42*b* tends to move away from wall 47 thus drawing liquid from channel portion 48. However, as described above, the low pressure zone formed at the venturi retards the outward flow in channel portion 48 resulting in a net flow of liquid radially inwardly through the venturi.

Thus, it is seen that the agitator 26 acts as a pump while oscillating in both the clockwise and counterclockwise direction without need of any valves to prevent the reverse flow of wash liquid.

An alternative embodiment of the invention is shown in FIGS. 4, 5 and 6. The upper portion 138 of the agitator 136 is in all respects identical to the upper portion 38 shown in FIGS. 2 and 3 and described above. The lower portion 139 of the agitator 126 is in most respects the same as the lower portion 39 shown in FIGS. 2 and 3 and described above with a few changes and additions which are described as follows.

Inlet openings 168 are moved inwardly on the skirt 132 to be adjacent the barrel 134 between two of the fins 136 located on the top side of the skirt 132. The inlet openings 168 are connected to channel portions 142*a* and 142*b* through a converging passage 174 formed by wall portions 145*c* and 145*d*.

Also communicating with the converging passage 174 is an opening 176 defined by the inner or bottom wall 141 of the hollow skirt 132. A plurality of vanes 178 are provided on the lower side of the bottom wall 141 to pump wash liquid that is located under the skirt outwardly around the peripheral portions of the agitator 126.

As the agitator oscillates, the pumping vanes 178 tend to create a flow of liquid through the inlet openings 168 to the opening 176 and through the vanes 178 to flow outwardly from under the agitator skirt 132. This flow of water prevents any clothing being washed in the basket 124 from being sucked or trapped under the agitator 126. The flow of liquid through inlet openings 168 is increased sufficiently to provide increased flow inwardly through the venturi 152 over that described above. In all other respects, the operation of the device of this embodiment of the invention is the same as that described above.

As is apparent from the foregoing specification, the invention is susceptible of being embodied with various alterations and modifications which may differ particularly from those that have been described in the preceding specification and description. It should be understood that I wish to embody within the scope of the patent warranted hereon all such modifications as reasonably and properly come within the scope of my contribution to the art.

The embodiments of the invention in which an exclusive property or privilege is claimed are defined as follows:

1. In a vertical axis automatic washer having a basket for containing clothes to be washed in a washing liquid, a vertical agitator shaft extending within said basket, a drive means for imparting oscillatory motion to said agitator shaft, a liquid pumping agitator mounted for oscillatory movement with said shaft, said liquid pumping agitator comprising:

a vertical barrel drivenly connected to said shaft, said barrel defining an outlet fluidly connected to said basket and an interior passage extending upwardly from a lower end of said barrel to said barrel outlet;

a skirt integrally connected to said lower end of said barrel, said skirt defining an interior annular passage means for pumping liquid to said barrel passage, an inlet fluidly connected to said basket and an outlet fluidly connected to said barrel passage, said annular passage fluidly connecting said skirt inlet and said skirt outlet; and a venturi means in said skirt outlet for retarding the flow of wash liquid from said skirt outlet to said skirt inlet, whereby washing liquid is pumped by the oscillatory motion of said agitator from said skirt inlet to said barrel outlet.

2. The apparatus of claim 1, wherein said interior passage in said barrel communicates with a chamber portion forming the interior of a wash liquid treatment member which has openings communicating with said basket.

3. The apparatus of claim 2, wherein said wash liquid treatment member comprises a filter means which is removably mounted on said barrel.

4. The apparatus of claim 1, wherein said skirt inlet is comprised of openings through a top wall of said skirt.

5. The apparatus of claim 1, wherein said skirt has an additional outlet below said skirt inlet and pumping vanes provided below said skirt, whereby said wash liquid is pumped under said skirt outwardly around peripheral portions of said agitator and additional wash liquid is drawn in through said skirt inlet to be pumped to said barrel outlet.

6. A washing machine agitator comprising:

a vertical barrel defining an outlet and an interior passage, said interior passage extending upwardly from a lower end of said barrel to said barrel outlet;

a skirt integrally connected to said lower end of said barrel, said skirt defining a liquid inlet, a liquid outlet to said barrel passage, and an interior annular passage means for pumping liquid through said skirt liquid inlet to said skirt liquid outlet; and a venturi means in said skirt liquid outlet for retarding the flow of wash liquid from said skirt liquid outlet to said liquid inlet.

7. For use in an automatic washer, an agitator means comprising:

a vertical barrel adapted to be driven in an oscillatory manner, said barrel having an interior passage extending upwardly from a lower end of said barrel to an outlet in said barrel;

a skirt integrally connected to said lower end of said barrel, said skirt defining an interior annular passage, an inlet opening through said skirt to said annular passage, and an outlet opening from said annular passage to said barrel passage; said inlet opening spaced from said outlet opening to define first and second liquid passages in said annular passage from said inlet opening to said outlet opening, said annular passage defining means for directing liquid from said first passage to said barrel passage when said agitator is driven in a first direction and for directing liquid from said second passage to said barrel passage when said agitator is driven in a second direction; and a venturi means in said annular passage at said skirt outlet opening for retarding the flow of wash liquid from said outlet opening to said inlet opening in one of said first and second passages when said agitator is driven to direct liquid from the other of said first and second passages to said barrel passage, whereby the oscillatory motion of said agitator in said automatic washer operates to pump washing liquid from said skirt inlet to said barrel outlet.

8. In an automatic washer of the type having an oscillatory agitator, the improvement of:

pumping means comprising channel means forming a lower horizontal circulatory path and a vertical path through said agitator through which liquid is to be pumped;

venturi means between said circulatory path and said vertical path; and a radial wall means in said lower circulatory path for diverting said liquid generally upwardly through said vertical path.

9. In an automatic washer as defined in claim 8, and further characterized by said channel means having a liquid inlet dividing said channel means into first and second passages and wherein said venturi means retards the flow of liquid in said first and second passage toward said inlet.

* * * * *